United States Patent [19]

Katzakian

[11] 4,228,555

[45] Oct. 21, 1980

[54] WATER BED SHEET FRAME

[76] Inventor: Terry A. Katzakian, 101 John Muir Ct., Modesto, Calif. 95350

[21] Appl. No.: 35,086

[22] Filed: Apr. 30, 1979

[51] Int. Cl.[3] ..... A47C 27/08

[52] U.S. Cl. ..... 5/498; 5/400; 5/451

[58] Field of Search ..... 5/488, 496–498, 5/500, 451, 400, 401

[56] References Cited

U.S. PATENT DOCUMENTS

| | | | |
|---|---|---|---|
| 2,860,352 | 11/1958 | Pierre | 5/498 |
| 3,606,622 | 9/1971 | Williams et al. | 5/498 |
| 3,681,795 | 8/1977 | Palenske et al. | 5/497 |
| 4,015,299 | 4/1977 | Tinnel | 5/496 |
| 4,089,075 | 5/1978 | May | 5/498 |

*Primary Examiner*—Casmir A. Nunberg
*Attorney, Agent, or Firm*—Blair, Brown & Kreten

[57] ABSTRACT

Disclosed herein is a frame network to be used in association with a water bed to secure the bed sheets thereon defined by a pair of spaced rectangular frames disposed along the top edge of a water bed in which the top most rectangular frame pivots relative to the bottom most frame at one end of the bed, preferably along the head board. The upper frame is so constructed that the rod closest to the head board is removable and insertable within a sleeve of the bottom portion of a bed sheet, and the side edges thereon similarly have sleeves so that side rods forming a portion of the framework are threaded therethrough. The end or foot portion of the bed sheet is looped over a portion of the frame work parallel to the head board and the sheet is doubled over so as to serve as a top sheet. A pad positioned between the sheet and the mattress is affixed to the lower frame, and a further sheet which extends under the mattress is secure to the bottom edge of the lower frame. Hardware is provided to allow the upper frame and portions thereof to rotate relative to the lower frame, these hardware elements being located at the corners of the upper most frame.

10 Claims, 6 Drawing Figures

3.
4.
10
4.
3.
F
21
20
2
22
23
1
24
3
23
7
6
10

8
5
6
5
9
11
4

WATER BED SHEET FRAME

BACKGROUND OF THE INVENTION

Since the inception and concomitant popularity of water beds in society, the most salient difficulty associated therewith involves making the bed, and assuring that the bed sheets remain in position once disposed thereon. The fundamental problem in disposing and retaining sheets on a water bed exist because of the fluid nature of the water within the water bed bladder. Deflections of the bed can cause a water bed to roll up around the edges thereby releasing a sheet which may be tucked thereunder.

Prior art devices of which applicant is aware include the following U.S. Pat. Nos.: 2,498,055 Veit, 3,606,622 Williams et al 2,567,072 Kay, 3,681,795 Palenske et al 2,679,056 Simpson.

The most pertinent patent appears to be Williams et al since he teaches the use of slats within bed sheets formed therein by threading slats through sleeves along the outer edges of the bed sheet, in which the express purpose for same is to prevent the bottom sheet from becoming wrinkled or sliding during use. It should be appreciated however that this invention was contemplated for a bed mattress that enjoys a structural rigidity substantially greater than that which is enjoyed by a water bed, and therefore where as the solution that Williams provides does indeed tend to retard wrinkling and migration of the bottom sheet, the mere disposition of slats along edge portions of the top and bottom of a bed would not provide the beneficial retention that is necessary when used in the water bed environment. Further structural differences also occur as will be defined hereinafter in the specification, and the one most noteable distinction includes the pair of upper and lower spaced frames.

SUMMARY OF THE INVENTION

Accordingly, an object of this invention is to provide a retention device for holding sheets, mattress covers, an insulative shroud and the like on a water bed which is easy to install, and once installed impossible to unintentionally be dislodged.

A further object contemplates providing a device of the character described hereinabove wherein the framework used to constrain the sheets is durable in construction, relatively inexpensive to manufacture, and reliable in use.

These and other objects will be made manifest when considering the ensuing detailed description of the preferred embodiment taken in association with the drawing figures.

DESCRIPTION OF THE PREFERRED EMBODIMENT

Figures 1, 2:
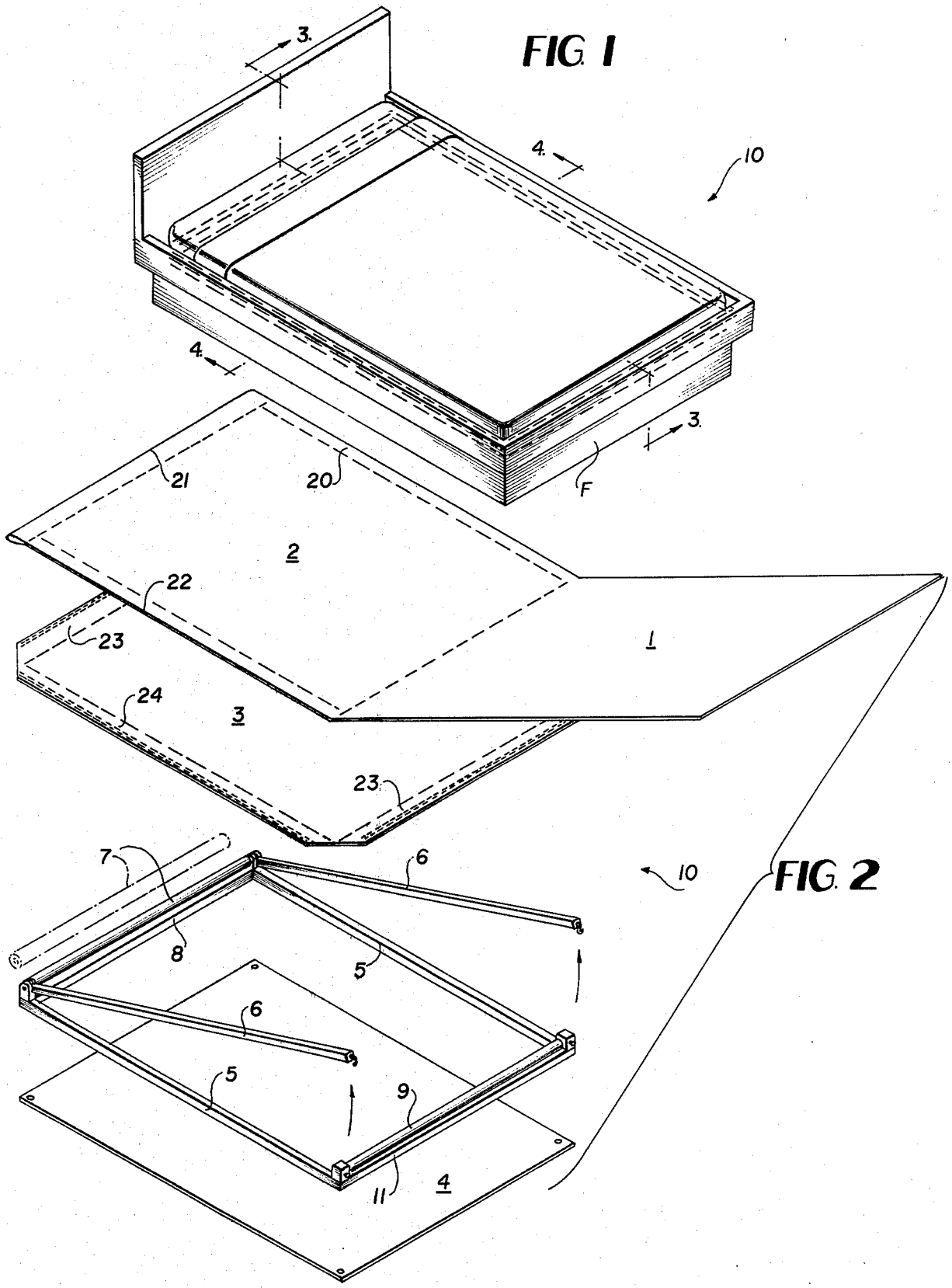
FIG. 1 is a perspective view of the water bed according to the present invention utilizing this device, the device being shown in phantom.
FIG. 2 is an exploded parts view of the components defining the present invention.

Referring to the drawings now, wherein like reference numerals refer to like parts throughout the various figures, reference numeral 10 is directed to the apparatus according to the present invention.

The structure associated therewith includes a sheet having a length twice that of the length of the bed in which the top portion 1 is folded over the bottom portion 2, and three side of the bottom portion 2 remote from the folded area is provided with a perimetral sleeve 20, 21 and 22. Lying thereunder is a pad 3 provided with parallel marginal areas 23 and 24 which can similarly form a loop of sleeve and the function thereof will be discussed hereinafter. A lower blanket 4 underlies the mattress, (the above discussed sheets lie above the mattress) in which the lowermost blanket 4 can serve as an insulator, a safety liner, or both. The perimeter thereof is fastened to the frame which will now be defined.

The frame itself is defined by a pair of vertically spaced rectangular grids in which the lowermost rectangular grid is defined by a pair of spaced parallel rods 5 interconnected at their extremities by a head frame member 8 and a foot frame member 11. The areas of interconnection between these four lower elements is preferably non-detachable. This lower frame supports an upper frame through vertical posts 25 (FIGS. 5, 6) disposed at the four corners thereof, and the upper frame comprises a detachable pole 7 located at the head of the bed parallel to frame member 8, and two downwardly extending parallel elongate rod members 6 pivotable about the axis defined by the head rod 7 when in position. The extremity of these elongate rods 6 remote from the head and therefore nearest the foot of the bed is latched so as to be constrained thereagainst. The upper rod 9 located near the foot of the bed is effectively non-detachable and serves as a rolling support where the bottom sheet portion 2 folds with the upper sheet portion 1.

Figure 3:
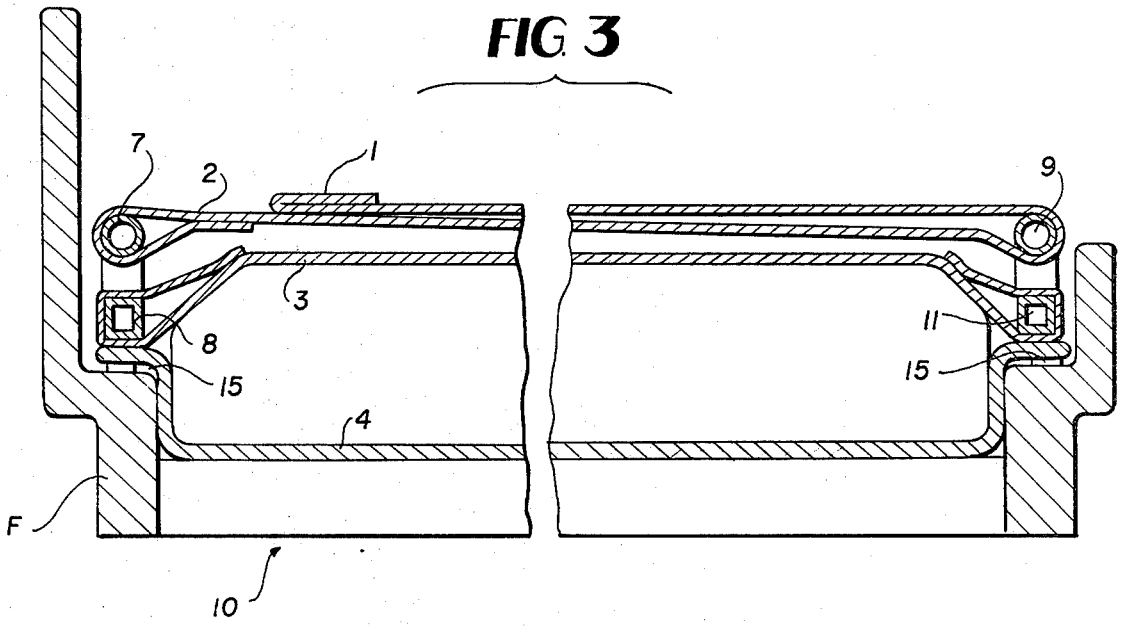
FIG. 3 is a sectional view taken along lines 3—3 of FIG. 1.
Figure 5:
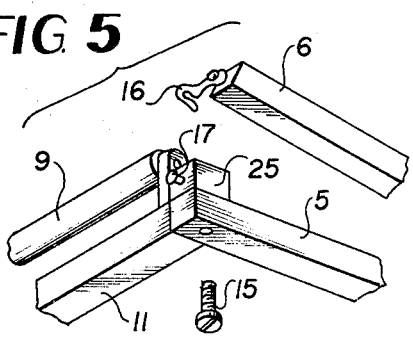
FIG. 5 is an exploded parts view showing the structural details of one corner of the apparatus according to the present invention perferably at the foot of the bed.

The head rod 7 is detachably affixed to the frame by means of a pin 13 which can be pulled outwardly away from the rod 7 and therefore the terminal portion of the pin which extends into hole 14 of rod 7 will be retracted allowing rod 7 to be translated vertically upward. The side rods 6 are hinged as at 12 and in fact can pivot through the pin 13 if so desired. In making a bed therefore the head rod 7 is threaded through the sleeve 21 of the bottom sheet portion 2, and the side rods 6 are threaded through the sleeves on the side edges of the sheet portion 2 as shown as sleeves 20 and 22. The scored area separating the bottom sheet portion 2 from the top sheet portion 1 underlies the foot board rod 9 and is looped thereover as shown in FIG. 3 so that the top sheet is securely affixed to the bed. After the side sleeves 20 and 22 are disposed on the rods 6, the rods are locked next to rod 9 through a hook 16 and pin 17 disposed on the rod 6 and lower frame post 25 as shown in FIG. 5.

Figure 4:
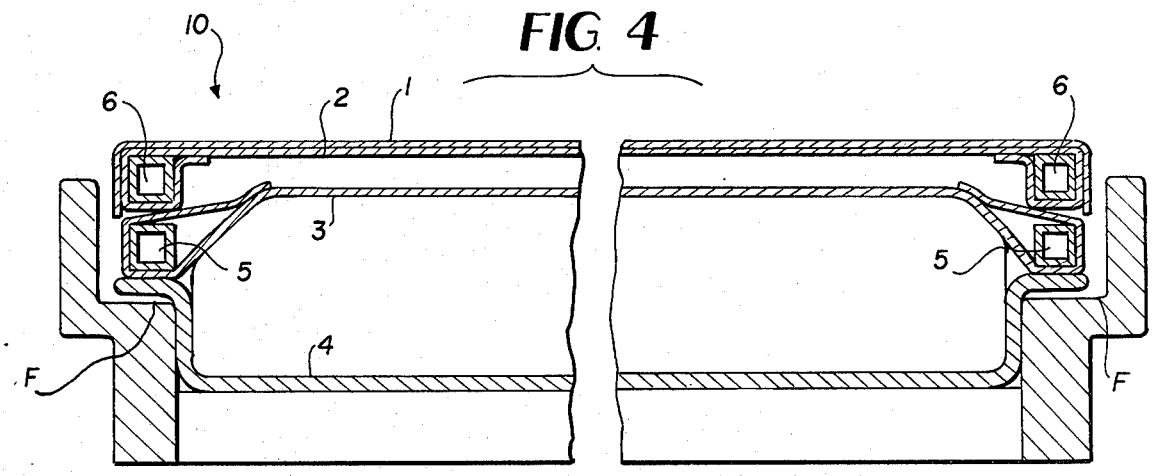
FIG. 4 is a sectional view taken along lines 4—4 of FIG. 1.
Figure 6:
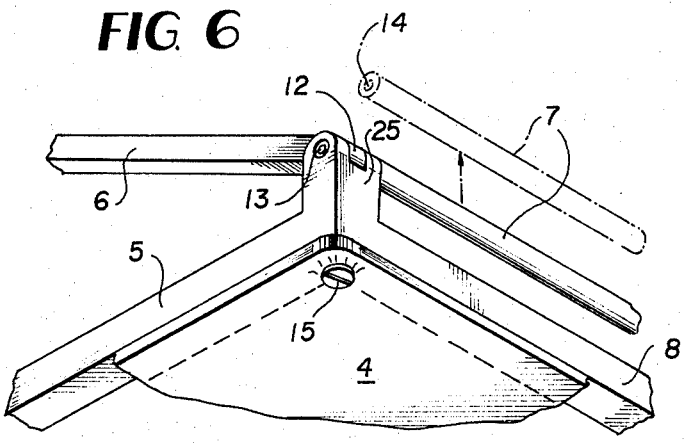
FIG. 6 is a perspective view of a corner according to the present invention showing additional hardware preferably at the top or head of the bed.

The lower most framework not only serves to support the upper framework but also provides a means for fastening the pad 3 thereto. FIG. 4 details how the marginal portions 24, 23 are looped over the lower frame and fastened to itself as with Velcro fasteners so that this pad 3 is firmly affixed. The bottom edge of the lower frame can provide a suitable area in which the pad 4 which underlies the water bed can be affixed as through large plastic screws 15 which traverse through the lower most pad 4 and into the frame members 5 and 8 at the corners as shown in FIG. 6. This lower most pad 4 can be an insulated jacket so as to retain heated water within the bed, or it can be a safety liner which would prevent loss of fluid should the bladder break, or it may serve as a combination of the two.

Having thus described the invention it should be noted that a shelf area F has been provided on the frame but that this shelf area is not mandatory and the pair of frames can be supported by the water bed frame as through the corner posts 25.

Further having described this invention it should be appreciated that numerous structural modifications are contemplated as being a part of this invention as specified hereinabove and as defined hereinbelow by the claims.

What is claimed is:

1. A frame structure for securing sheets to a water bed comprising, a water bed frame defining an interior for supporting a water mattress, removable frame means arranged to be supported on said water bed frame within said interior in overlying relationship with said water mattress with said frame means extending along the top inner periphery of said water bed frame, and sheet means detachably connected to said frame means along the periphery of said sheet means in overlying relationship with said water mattress and within the interior of said water bed frame.

2. The device of claim 1 in which said frame means comprises a pair of upper and lower vertically spaced substantially rectangular frames, said upper frame being pivotable about said lower frame.

3. The device of claim 2 wherein said upper frame comprises a pair of spaced parallel head and foot rods and side rods extending therebetween at the extremities of said pair of rods and said head rod is removable from the frame.

4. The device of claim 3 in which said side rods pivot about the head rod.

5. The device of claim 4 in which said head rod is removable and said side rods are pivotable by means of a pin extending through a vertically upstanding element supported on the lower frame having ahole therein whereby said pin extending therethrough extends into a hole on said head rod and said pin serves as a pintle about which the side rods rotate.

6. The device of claim 5 in which the side rods have extremities remote from the head rod proximate to the foot rod and are fastened thereto by means of a hook which overlies a pin disposed on a vertical extension eminating from the lower frame.

7. The device of claim 6 in which said lower frame serves to constrain a pad which overlies the bed, said pad having a marginal portion adapted to be looped over said lower frame and be doubled over on itself by fastening means.

8. The device of claim 7 in which said sheet means is of a length substantially twice that of the length of the bed and said sheet means is adapted to be looped over the foot pole so as to form top and bottom sheets, said bottom sheet having a marginal portion remote from the folded over area provided with sleeves through which extend the head rod and side rods.

9. The device of claim 8 in which a further pad underlies said water bed and is fastened to a bottom face of the lower frame.

10. The device of claim 9 in which said lower most sheet defines an insulative membrane.

* * * * *